United States Patent [19]

Gilbert

[11] Patent Number: 4,498,791

[45] Date of Patent: Feb. 12, 1985

[54] PRINTER HAVING IMPROVED STORED ENERGY PRINTHEAD

[75] Inventor: Don M. Gilbert, Houston, Tex.

[73] Assignee: Texas Instruments Incorporated, Dallas, Tex.

[21] Appl. No.: 479,548

[22] Filed: Mar. 28, 1983

[51] Int. Cl.[3] ..... B41J 3/12

[52] U.S. Cl. ..... 400/124; 101/93.01; 101/93.05; 400/157.2; 400/166

[58] Field of Search ..... 400/121, 124, 157.2, 400/166; 101/93.01–93.05; 335/232, 234, 268

[56] References Cited

FOREIGN PATENT DOCUMENTS

| | | | |
|---|---|---|---|
| 49278 | 5/1981 | Japan | 400/166 |
| 212073 | 12/1982 | Japan | 400/166 |
| 36469 | 3/1983 | Japan | 400/124 |

*Primary Examiner*—Paul T. Sewell

*Attorney, Agent, or Firm*—Thomas G. Devine; Leo N. Heiting; Melvin Sharp

[57] ABSTRACT

A multicopy impact printer has a wire matrix stored energy printhead having circuitry for reducing the power requirement of the printhead. A permanent magnet is incorporated in the printhead to flex leaf springs each of which is attached to the corresponding activation end of a respective one of a plurality of print members. A coil is provided for each print member, being activated when selected, to provide a magnetic field in opposition to the magnetic field of the permanent magnet and of an amplitude sufficient to release the flexed leaf spring. The opposing field diverts the field of the magnetic coil into paths away from the activated coil, thereby increasing its intensity and requiring more current in other selected coils to release the corresponding flexed leaf springs. A common coil is connected at one end to one end of each of the printer element coils and wound and positioned to provide a field in opposition to that of the permanent magnet. Currents in the respective selected printer element coils add in the common coil so that the magnitude of the opposing field is dependent upon the number of selected print element coils.

15 Claims, 7 Drawing Figures

PRINTER HAVING IMPROVED STORED ENERGY PRINTHEAD

BACKGROUND OF THE INVENTION

1. Field of the Invention

This invention relates to an impact printer and more particularly to a wire matrix printer having a stored energy printhead.

2. Description of the Prior Art

In matrix printing, the wire matrix employed in forming each alpha-numeric character is defined by a predetermined number of impressions arranged in a column which may be vertical or inclined and which is advanced to a predetermined number of laterally spaced positions, or submultiples thereof. For example, a 9×9 matrix is comprised of nine print members, each capable of printing a dot in the column in each of nine parallel columns. By controlled vertical and horizontal additional printing of dots, through various known techniques, a higher quality font may be obtained.

In the past, a plunger magnet type wire matrix printhead has been employed. Each print member is driven by its own solenoid with the activation ends thereby being spread rather widely apart and with the impression ends being very close together. This requires the use of a long, curved wire which involves various problems such as breakage and wear. This type of head is shown in U.S. Pat No. 4,091,909.

Another prior art head is the clapper type which involves an armature that strikes the print member (ballistic type) or is attached to the print member (solid type). The solid type is more suitable for high-speed operation than the ballistic type because it involves no collision between the armature and the print member.

More recently, a stored energy or spring charge type wire matrix printhead has been employed for particularly high-speed applications. In this type, a leaf spring connected to each print member is flexed by a magnetic field. By selectively overcoming that field, the flexed leaf spring drives the print member into contact with the paper. The disadvantage of this high-speed printhead is the large amount of power required and the resultant heat generated in the head.

The present invention has the advantages of the stored energy printhead, but has a drastic reduction in the power required and therefor in operational temperature.

BRIEF SUMMARY OF THE INVENTION

The novel printhead of this invention employs a permanent magnet positioned in the head so that its field attracts 9 leaf springs, each attached to its own print member. The springs are thereby held against the permanent magnet. There is a coil provided for each of the print members. When a print member is selected, its associated coil is energized, producing a magnetic field in opposition to that of the permanent magnet. The associated flexed spring is thereby released, driving its associated print member.

The opposing field set up by the individual coil causes a diversion of the permanent magnet field, thereby concentrating that field in the leaf springs associated with the non-selected print members. When another print member is selected, the concentration in the remaining unselected print member leaf springs is increased. A requirement for more and more power exists.

To reduce this requirement, this inventive printhead has a common coil which, when activated, provides a field in opposition to that of the permanent magnet. The individual print member coils are connected together at one end and then connected to the common coil so that the currents in the individual coils are added in the common coil. When one coil is activated, current from that coil flows in the common coil, thereby producing a field of a given strength to oppose the concentrated permanent field. If three coils are selected, then the current from all three coils provide current for the common coil which produces a field proportional in strength to current flowing through it to oppose the increasingly concentrated field. In this manner, the power requirement for selecting, for example, the ninth print member, is greatly reduced. That is, with the permanent magnet field concentrated in one leaf spring, a large amount of power is required in the ninth coil to overcome that field, but through the use of the common coil of this invention, the power requirement is greatly reduced.

Therefore, it is a principal object of this invention to provide a printer with a stored energy printhead having a greatly reduced power requirement.

Another object of this invention is to provide a printer having a stored energy printhead that operates at a lower temperature.

It is still another object of this invention to provide a printer having a stored energy printhead with a smaller power supply.

These and other objects will be made evident in the detailed description that follows.

DETAILED DESCRIPTION OF THE INVENTION

The impact printer of this invention may be a model TI840 manufactured by Texas Instruments Incorporated. The combination with the improved stored energy printhead provides a high speed printer with lower power requirements and lower operating temperatures. For a detailed description of this invention, please refer first to FIG. 1.

Figure 1:
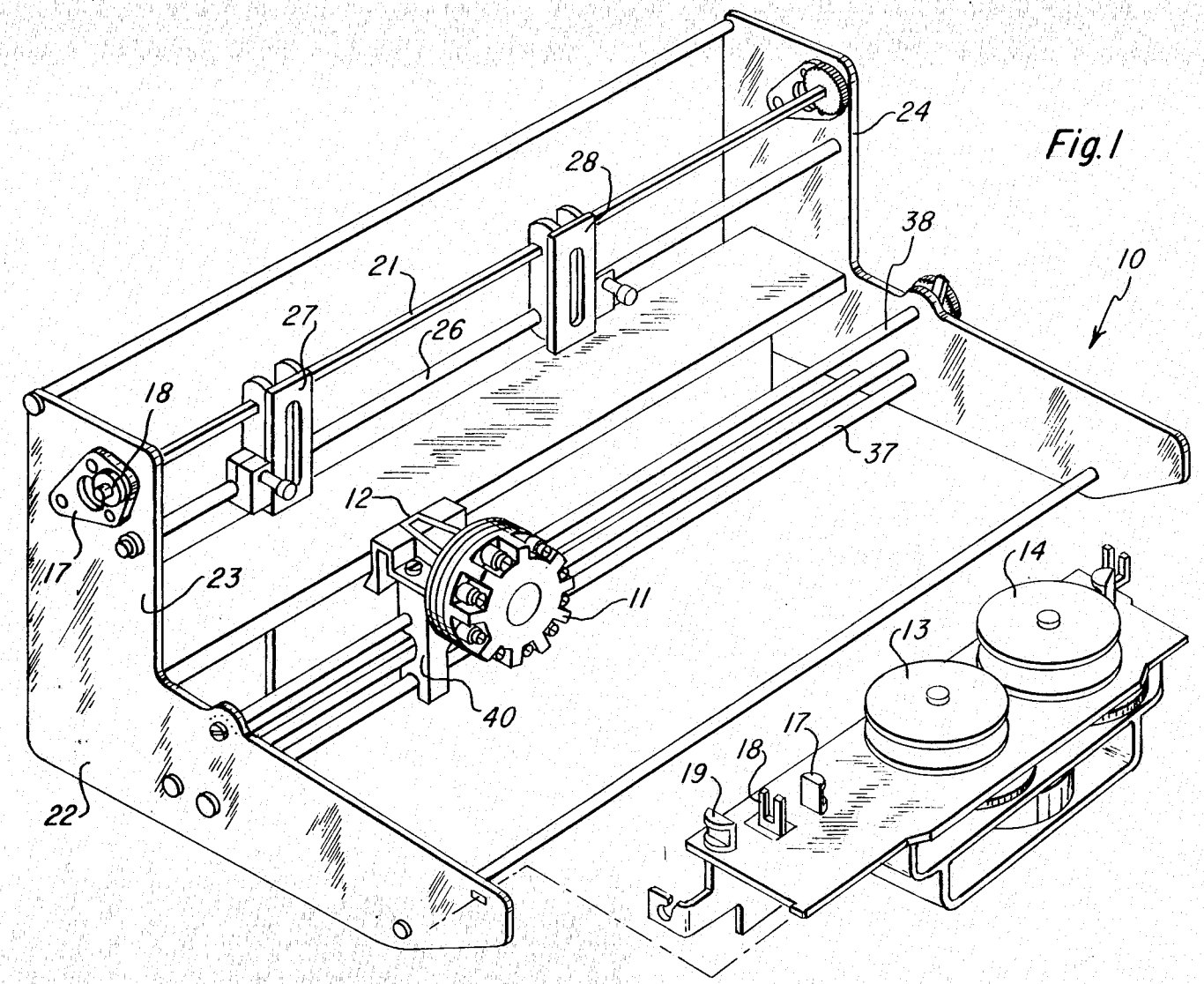
FIG. 1 is a partially exploded view of the section of an impact printer in which the inventive stored energy printhead is shown in position.

FIG. 1 shows the inner framework assembly 10 of the wire matrix impact printer which may be used with the improved printhead of this invention. Stored energy wire matrix print head 11, having an impact end 12, is shown as it is attached to carriage assembly 40. Carriage assembly 40 is shown attached to drive screw 38 and to guide shaft 37. The carriage assembly 40 is moved from left to right and from right to left by the turning of the drive screw 38 which is accomplished by an electric motor (not shown). Print ribbon reels 13 and 14 are shown as they are mounted in position.

Sidewall 22 has bracket assembly 17 mounted to its outer face 23. A similar bracket is attached to sidewall 24. The bracketing and associated drive shaft gear and bearing assembly is fully described in U.S. Pat. No. 4,115,014, assigned to the assignee of this invention. Drive shaft 21 is shown in place upon which are mounted tractors 27 and 28.

Figure 2:
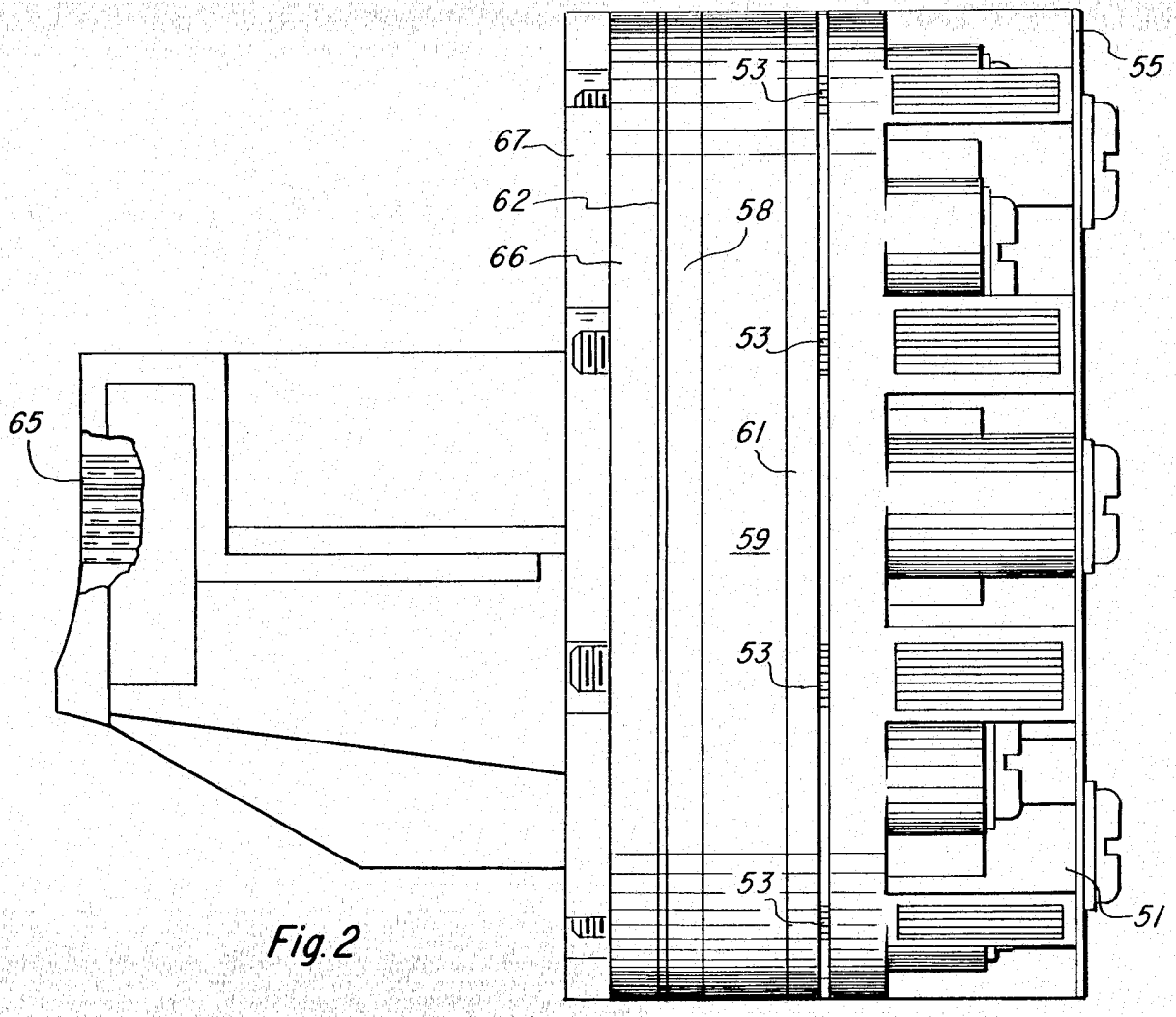
FIG. 2 is a side view of the printhead with a partial section taken at the front.

FIG. 2 is a side elevation of the stored energy printhead of this invention. Lamination assembly 51 is shown with flexible circuitry 55 connected thereto. Laminations 53 are shown in place in the assembly 51 and abutting flux plate 61 of permanent magnet assembly 60 which further includes flux plate 58. Armature assembly 62 is sandwiched between flux plate 58 and flux plate 66. Needle housing 67 completes the structure, being connected to flux plate 66. A section of housing 67 is cut away to illustrate the positioning of print members 65. It should be noted that the permanent magnet assembly 60 may be replaced with an appropriate electromagnet.

Figure 3:
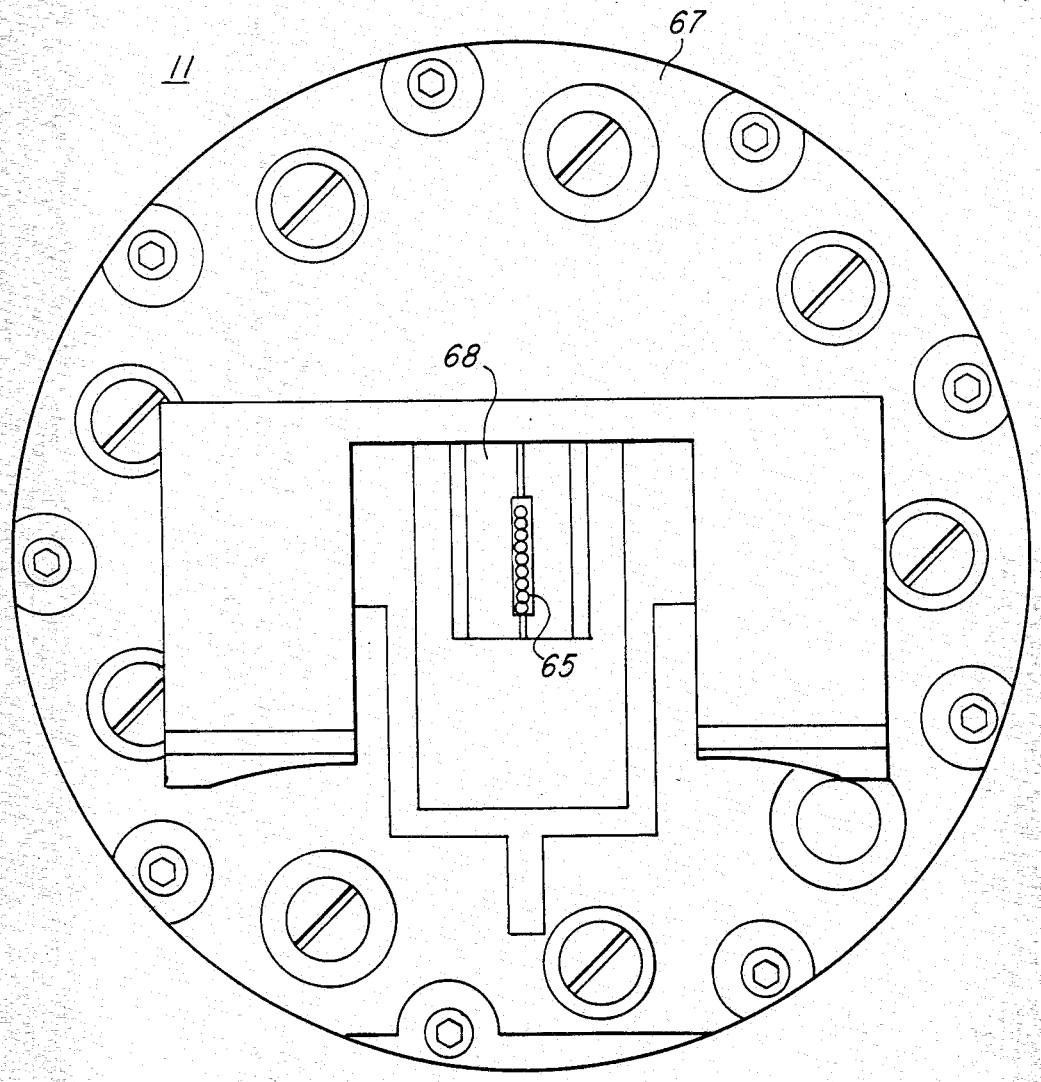
FIG. 3 is a front view of the printhead.

FIG. 3 is a front view of the stored energy printhead illustrating needle housing 67 with print members 65 in place in sapphire bearing assembly 68. The selection of sapphire is, of course, an arbitrary one with other bearing surfaces being readily substitutable.

Figure 4A:
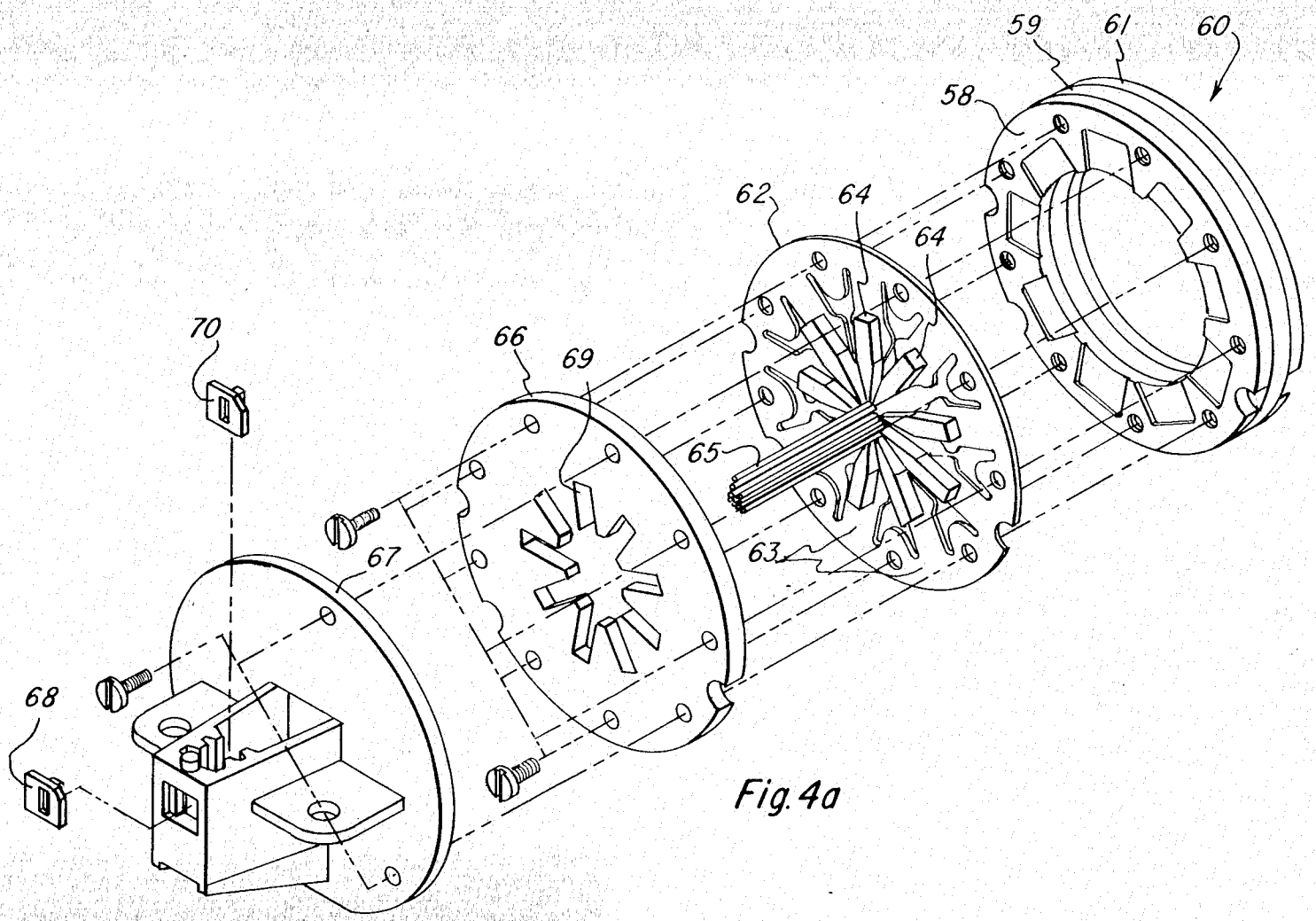
FIGS. 4*a* and 4*b* form an exploded view of the printhead.
Figure 4B:
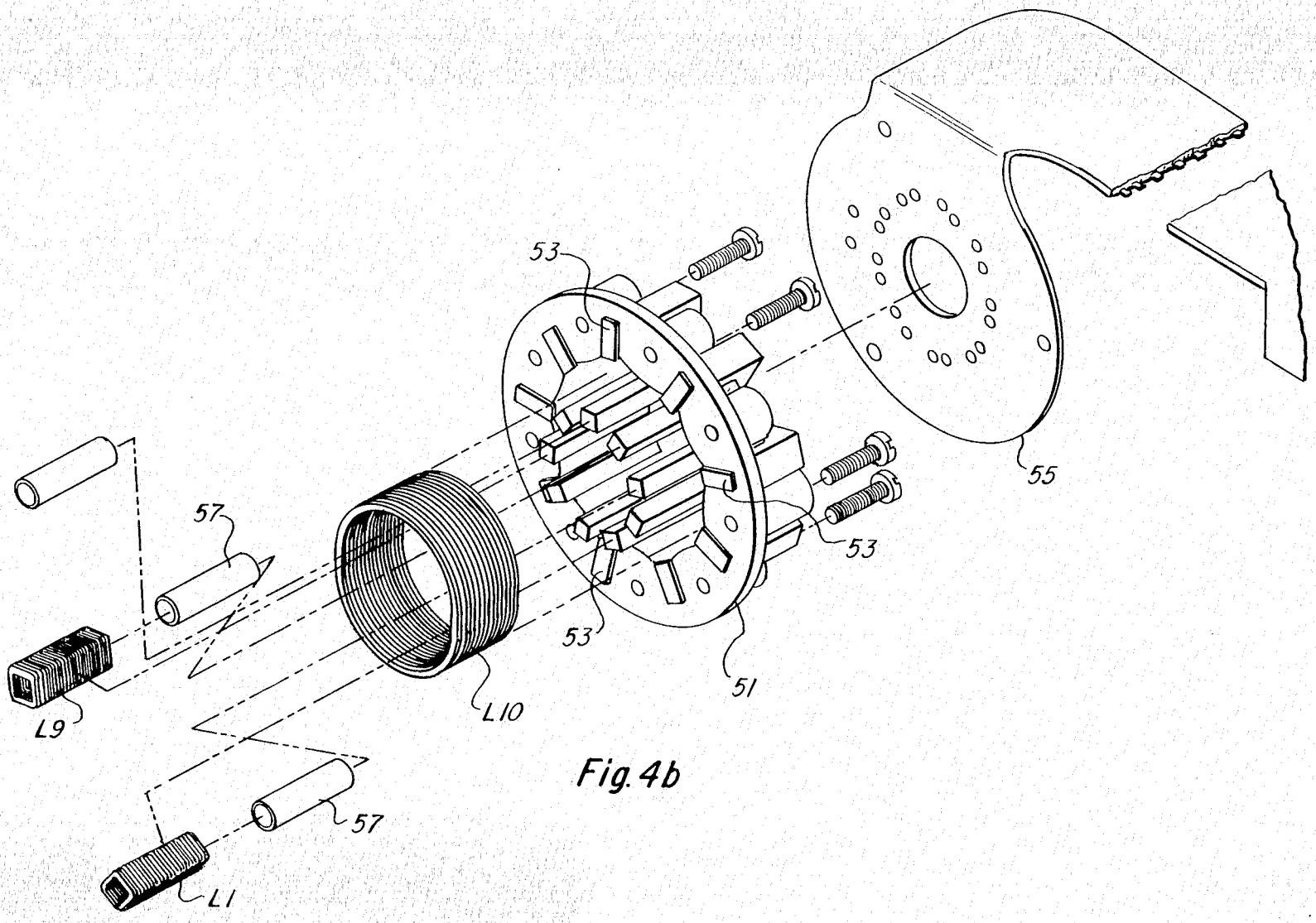

FIG. 4*a* and FIG. 4*b* illustrate the complete assembly of the stored energy wire matrix printhead of this invention. Needle housing 67 is shown with guide assembly 70 and sapphire bearing 68 positioned as illustrated. Flux plate 66 is mounted to armature assembly 62. Armature assembly 62 includes nine print members 65-1 through 65-9 each attached to a spring member 63-1 through 63-9 to which is attached a stiffening and flux plate 64-1 through 64-9. Stiffening and flux plates 64 fit within grooves 69 of flux plate 66, thereby completing a flux path through flux plate 66 and each of stiffening and flux plates 64. Front flux plate 58 is attached to the magnet 59 which in turn is attached to rear flux plate 61 to make up magnet assembly 60. Flux plate 58 is configured to provide nine fulcrums for the nine springs 63 of armature assembly 62. Thus, when the assembly is in place, the springs 63, together with the corresponding stiffening and flux member 64 are pulled toward magnet assembly 60.

FIG. 4*b* illustrates print member coils L1 and L9, and insulators 57 over which the print member coils L1–L9 fit. Only two of these assemblies are shown, but it is understood that there is, in this preferred embodiment, a total of nine. This number is a design choice.

Lamination assembly 51 has nine laminated posts 52 which terminate in laminated faces 53. The laminated faces 53 directly contact flux plate 61. Flexible printed circuit 55 is connected to lamination assembly 51 for providing electrical signals to the print member coils L1–L9. In this preferred embodiment, these signals are provided by a TMS 7041 microprocessor, a product of Texas Instruments Incorporated. The selection of microprocessor is arbitrary.

Common coil L10 is shown as it is positioned partially within lamination assembly 51 and also within permanent magnet assembly 60. Common coil L10 is connected to print member coils L1–L9 as shown in FIG. 6.

Figure 5:
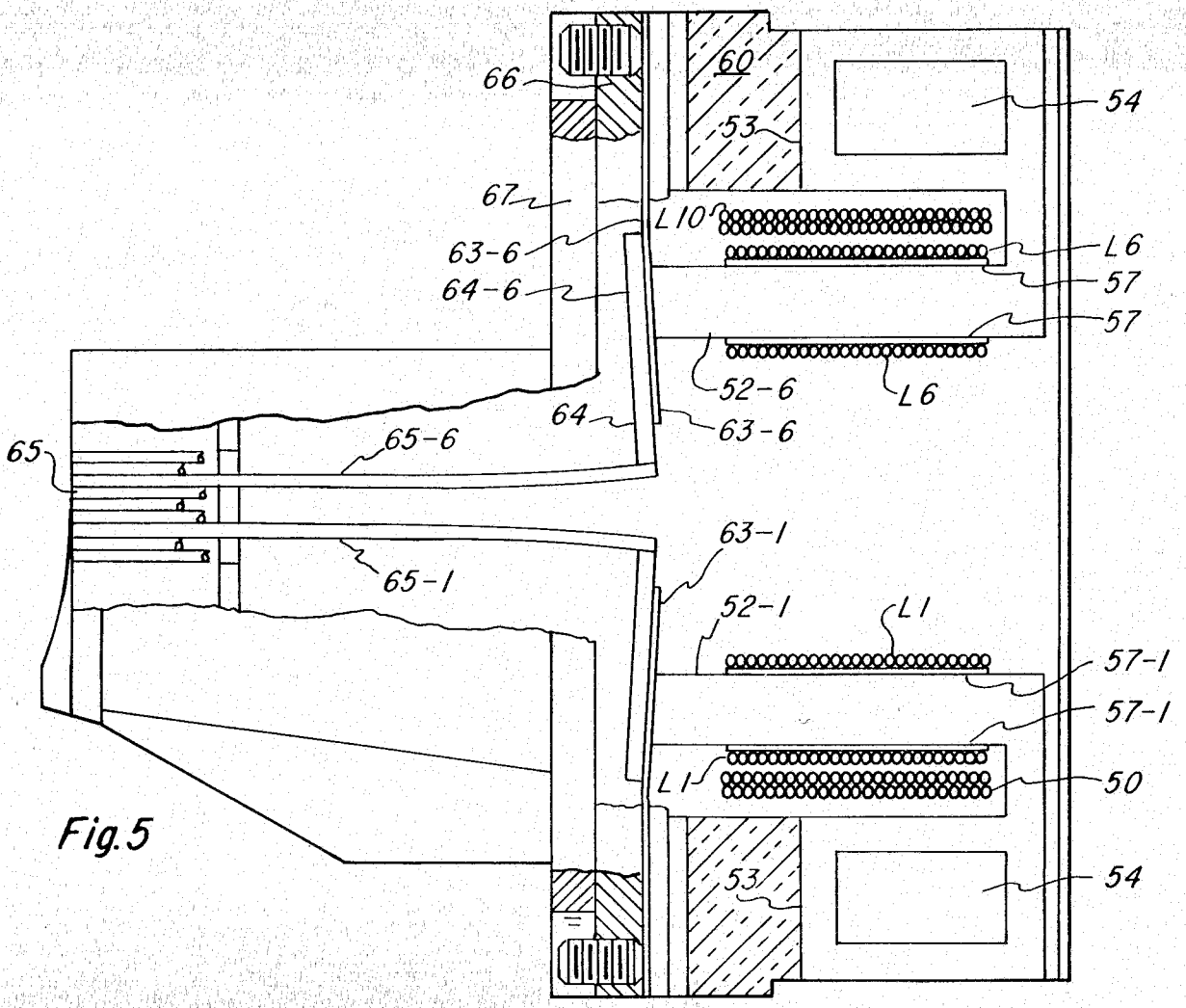
FIG. 5 is a cross section of the printhead.

FIG. 5 is a cross section of the stored energy printhead and illustrates, for the sake of simplicity, only the first and sixth print members and associated coils L1 and L6, respectively. Laminations 52-1 are shown with insulator 57-1 surrounding the laminations and insulating them from print element coil L1. Laminations 52-1 are formed in a U shape with one leg truncated and with an aperture 54 in the truncated leg. Aperture 54 is made for purposes of molding assembly 51 and holding the laminations 52-1 and 52-6 in place. Print members 65-1 and 65-6 are illustrated with their respective springs 63-1 and 63-6, together with the stiffening and flux plates 64-1 and 64-6 in the flexed position. Common coil L10 is shown in cross section surrounding the print member coils L1 and L6.

Figure 6:
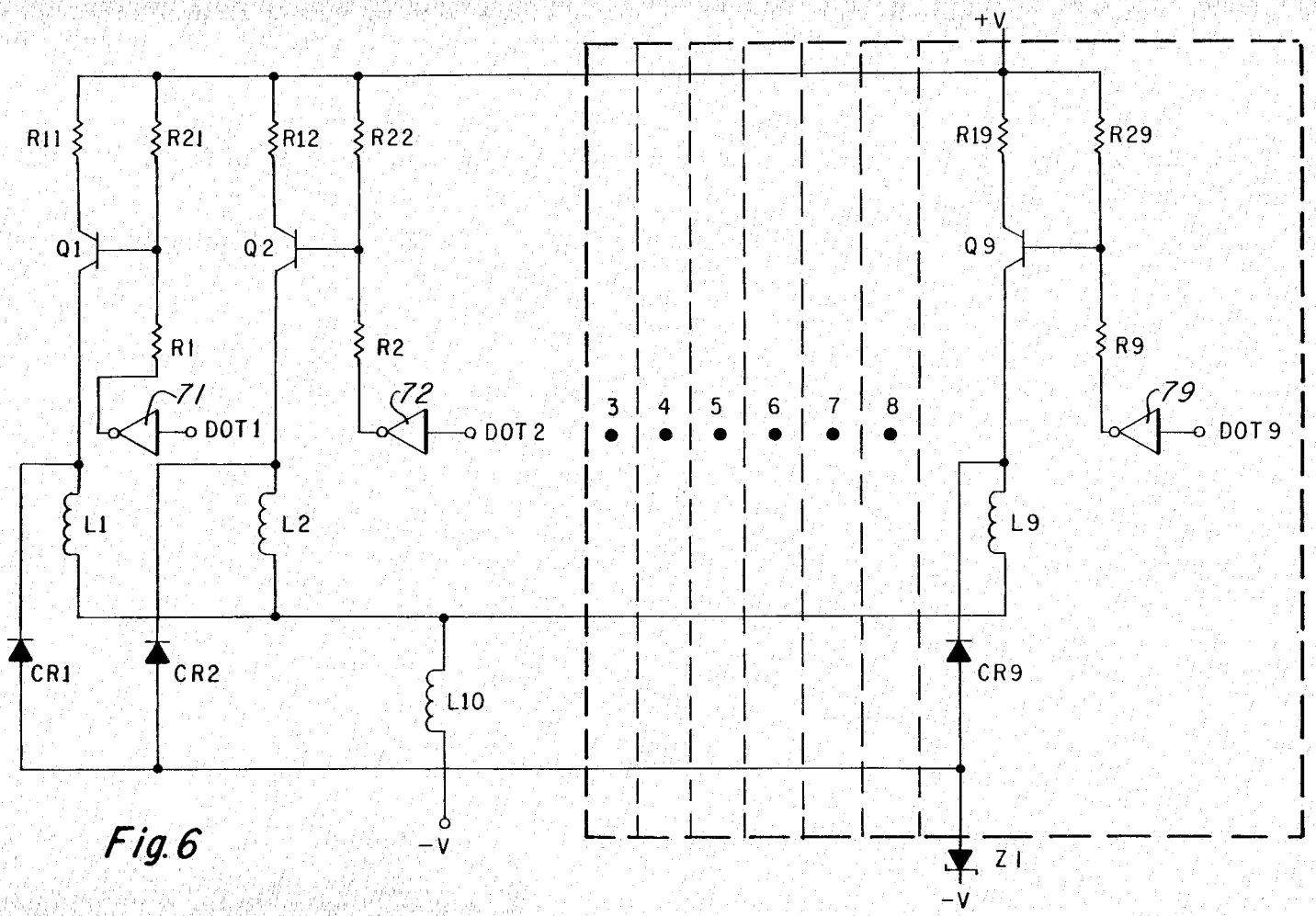
FIG. 6 is a schematic of three of the nine drive circuits.

FIG. 6 is a schematic diagram illustrating the circuitry of print member coils L1, L2 and L9. The circuitry for coils L3–L8 is exactly the same as that illustrated for coils L1, L2 and L9. Input "DOT 1" is shown applied to inverter 71 whose output is applied, through resistor R1 to the base of transistor Q1 and through resistor R21 to a source of positive voltage (+V). The emitter of transistor Q1, through resistor R11, is connected to that positive voltage source. Its collector is connected, through coil L1 to one end of common coil L10 whose other end is connected to a negative voltage source (−V). The collector of transistor Q1 is also connected to the anode of diode CR1 whose cathode is connected to the cathode of Zener diode Z1 whose anode is connected to the negative voltage source. As shown, the circuitry for "DOT 2" and for "DOT 9" is exactly the same, with corresponding transistors Q2 and Q9 and print element coils L2 and L9, together with associated circuitry. The "DOT 1–DOT 9" inputs are supplied from the TMS 7041 microprocessor, as indicated above.

MODE OF OPERATION

With reference to FIG. 6, when an input is applied from the microprocessor as a "DOT 1" signal, for example, transistor Q1 is turned on permitting current to flow through print element coil L1. The current flowing through coil L1 will then flow through common coil L10. If "DOT 2" provides an input as well, then the currents from both coils L1 and L2 will flow through coil L10, and if selected, coil L9's current will also flow through common coil L10. As any or all of these DOT inputs cause current to flow through their respective print element coils, coil L10 will provide a larger and larger field.

With the particular components used in this invention, 0.9 amperes for a single print element coil is required. If all of the nine print element coils L1–L9 are selected, then the current required per print element coil is $150\% \times 0.9 = 1.35$ amps. The total current is 1.35 amps $\times 9 = 12.15$ amps. The total print cycle is 1100 microseconds and the turn-on time for the individual coils is 350 microseconds. The impedance of each coil is 5.2 ohms so that:

$$(1)\ \text{Power} = 350/1100 \times 5.2 \times 1.35^2 \times 9 = 27.1 \text{ watts}$$

In accordance with this invention, the common coil L10 provides an opposing field to that of the permanent magnet that increases with each one of coils L1–L9 being selected so that the total current required in those coils, no matter how many are selected, does not exceed 0.9 amps. Thus:

$$(2)\ \text{Power} = 350/1100 \times 5.2 \times 0.9^2 \times 9 = 12.1 \text{ watts}$$

From a comparison of equation 1 with equation 2, it is readily apparent that the power consumed in the inventive head is less than ½ of that consumed in the prior art head, in the worst case. The heat loss is thereby reduced in the same proportion as the lesser power requirement.

Reference should now be made to FIG. 5. Assuming that coils L1 and L6 are selected, then a counter field to the permanent magnet is set up by coils L1 and L6 surrounding laminations 52-1 and 52-6. The field produced is additive from coils L1 and L6 as shown in FIG. 6 and directly opposes the permanent magnet field which has been guided through the laminations 57-1 and 57-6, respectively. The opposing field set up by coils L1 and L6, respectively, reduce the flux in the laminations to a value of zero or some other predetermined low level which then removes the effective field from springs 63-1 and 63-6, allowing the springs to rapidly spring back causing print elements 65-1 and 65-6 to impact the paper.

Those skilled in the art are aware that multiple rows of print elements may be employed, and particulars of the circuitry may be changed, all without departing from the scope of the appended claims.

What is claimed is:

1. A multicopy printer for printing desired impressions on a print medium, comprising:

(a) a movable printhead carriage assembly for traversing the print medium; and (b) a wire matrix printhead mounted on the printhead carriage assembly, comprising:

a plurality of print members, each having an impression end and an activation end, front bearing means through which the impression ends pass, disposed in a confronting relation to the print medium, magnetizable resilient means connected to each of the activation ends, stored energy magnetic means positioned to provide an attracting force to flex the magnetizable resilient means, thereby setting the print members for activation, a plurality of print member magnetic means associated with each of the print members, respectively, to selectively provide an attracting force in the opposite direction from that of the stored energy magnetic means thereby reducing its attracting force by a predetermined amount to rapidly release the selected flexed magnetizable resilient means, driving the associated print member impression end into contact with the print medium, and opposing magnetic means, positioned to selectively oppose the attracting force of the stored energy magnetic means and connected to provide a strength of magnetic field that is directly proportional to the number of print member magnetic means selected, thereby reducing the resultant concentrated attracting force of the stored energy magnetic means in the unselected magnetizable resilient means.

2. The printer of claim 1 wherein the magnetizable resilient means comprises a separate leaf spring attached to each of the activation ends of the print members.

3. The printer of claim 1 wherein the stored energy magnetic means comprises a permanent magnet.

4. The printer of claim 2 wherein the stored energy magnetic means comprises a permanent magnet.

5. The printer of claim 1 wherein the plurality of print member magnetic means comprises an individual coil for each print member, positioned and wound in a direction to provide when selected a magnetic field opposite to that of the stored energy magnetic means and of an amplitude to permit immediate release of the associated magnetizable resilient means.

6. The printer of claim 3 wherein the plurality of print member magnetic means comprises an individual coil for each print member, positioned and wound in a direction to provide, when selected, a magnetic field opposite to that of the permanent magnet and of an amplitude to permit immediate release of the associated leaf spring.

7. The printer of claim 6 wherein the opposing magnetic means comprises a common coil, wound in a direction and positioned to provide a magnetic field, when energized, opposite to that of the permanent magnet, connected at one end to one end of each of the individual coils so that the current flowing in each individual coil is additive in the common coil.

8. A stored energy wire matrix printhead comprising:

(a) a plurality of print members, each having an impression end and an activation end;

(b) front bearing means through which the impression ends pass;

(c) magnetizable resilient means connected to each of the activation ends;

(d) stored energy magnetic means positioned to provide an attracting force to flex the magnetizable resilient means thereby setting the print members for activation;

(e) a plurality of print member magnetic means associated with each of the print members, respectively, to selectively provide an attracting force in the opposite direction from that of the stored energy magnetic means thereby reducing its attracting force by a predetermined amount to rapidly release the selected flexed magnetizable resilient means, driving the associated print member impression ends through the front bearing means; and (f) opposing magnetic means, positioned to selectively oppose the attracting force of the stored energy magnetic means and connected to provide a strength of magnetic field that is directly proportional to the number of print member magnetic means selected, thereby reducing the resultant concentrated attracting force of the stored energy magnetic means and the unselected magnetizable resilient means.

9. The printhead of claim 8 wherein the magnetizable resilient means comprises a separate leaf spring attached to each of the activation ends of the print members.

10. The printhead of claim 8 wherein the stored energy magnetic means comprises a permanent magnet.

11. The printhead of claim 9 wherein the stored energy magnetic means comprises a permanent magnet.

12. The printhead of claim 8 wherein the plurality of print member magnetic means comprises an individual coil for each print member, positioned and wound in a direction to provide, when selected, a magnetic field opposite to that of the stored energy magnetic means and of an amplitude to permit immediate release of the associated magnetizable resilient means.

13. The printhead of claim 10 wherein the plurality of print member magnetic means comprises an individual coil for each print member, positioned and wound in a direction to provide, when selected, a magnetic field opposite to that of the permanent magnet, and of an amplitude to permit immediate release of the associated leaf spring.

14. The printhead of claim 13 wherein the opposing magnetic means comprises a common coil, wound in a direction and positioned to provide a magnetic field, when energized, opposite to that of the permanent magnet, connected at one end to one end of each of the individual coils so that the current flowing in each individual coil is additive in the common coil.

15. A method of printing desired impressions on a print medium using a wire matrix, stored energy printhead having a plurality of print members, each with an activation end and an impression end, a plurality of leaf springs, each attached to a corresponding print member activation end, comprising the steps of:

(a) providing a magnetic attracting force to flex the plurality of leaf springs thereby drawing back the corresponding print members;

(b) selecting print members by forming a magnetic field for the selected print member in opposition to the magnetic attracting force; and (c) generating an opposing magnetic field in opposition to the magnetic attracting force, the strength of the opposing magnetic field being proportional to the number of print members selected.

* * * * *